US010518932B2

(12) United States Patent
Schwab

(10) Patent No.: US 10,518,932 B2
(45) Date of Patent: Dec. 31, 2019

(54) DEVICE FOR ORIENTING A STACK OF CONTAINERS

(71) Applicant: Georg UTZ Holding AG, Bremgarten (CH)

(72) Inventor: Boris Schwab, Endingen (CH)

(73) Assignee: Georg Utz Holding AG, Bremgarten (CH)

( * ) Notice: Subject to any disclaimer, the term of this patent is extended or adjusted under 35 U.S.C. 154(b) by 290 days.

(21) Appl. No.: 14/068,608

(22) Filed: Oct. 31, 2013

(65) Prior Publication Data

US 2014/0117014 A1 May 1, 2014

(30) Foreign Application Priority Data

Nov. 1, 2012 (CH) ..... 2193/12

(51) Int. Cl.
*B65D 21/02* (2006.01)
*B65D 5/00* (2006.01)
(Continued)

(52) U.S. Cl.
CPC ..... *B65D 21/0224* (2013.01); *B65D 5/005* (2013.01); *B65D 5/006* (2013.01);
(Continued)

(58) Field of Classification Search
CPC .. B65D 21/0224; B65D 5/006; B65D 5/0055; B65D 5/0065; B65D 5/007; B65D 5/0075; A47B 47/0016; A47B 47/0025; A47B 47/0033; A47B 47/0091; A47B 47/047; A47B 87/02; A47B 87/0246; A47B 87/0276
(Continued)

(56) References Cited

U.S. PATENT DOCUMENTS 3,998,509 A * 12/1976 Hauser ..... A47B 47/0033 24/341
4,308,952 A * 1/1982 Paulucci ..... B65D 81/3205 206/216
(Continued)

FOREIGN PATENT DOCUMENTS

AU 2010100594 6/2010
DE 89 09 441 11/1989
(Continued)

*Primary Examiner* — Andrew T Kirsch
*Assistant Examiner* — Jennifer Castriotta
(74) *Attorney, Agent, or Firm* — Henry M. Feiereisen LLC

(57) ABSTRACT

A fixing element for orienting vertically stacked cuboid containers has first and second vertical sidewalls and a connecting element wherein the first sidewalls form a right angle with each other and the second sidewalls face the outer sides of the first sidewalls. The fixing element can be form fittingly fastened on the corners of a container, wherein a further container is arranged on the fixing element and is fixed in its horizontal position relative to the first container. The fixing element can be easily released again and reused. An embodiment is disclosed with a connecting element as spacer whereby a spacing of two containers is achieved. When two containers are thus stacked with their upper open sides facing each other a third container can be accommodated therein.

1 Claim, 12 Drawing Sheets

(51) Int. Cl.
*A47B 47/00* (2006.01)
*A47B 47/02* (2006.01)

(52) U.S. Cl.
CPC ..... *B65D 5/0055* (2013.01); *B65D 5/0065* (2013.01); *A47B 47/0016* (2013.01); *A47B 47/02* (2013.01)

(58) Field of Classification Search
USPC ..... 220/23.83, 729; 206/509, 503, 511, 512, 206/821, 504; 229/918, 915; 312/111
See application file for complete search history.

(56) References Cited

U.S. PATENT DOCUMENTS

| | | | | | |
|---|---|---|---|---|---|
| 4,493,425 | A * | 1/1985 | Yoshida | | 211/189 |
| 4,823,955 | A * | 4/1989 | Apps | | 206/506 |
| 4,930,636 | A * | 6/1990 | Meadows | B65D | 21/0224 206/503 |
| 4,971,201 | A * | 11/1990 | Sathre | | 206/509 |
| 5,431,336 | A * | 7/1995 | Clee | | 229/199 |
| 5,531,326 | A * | 7/1996 | Hummel et al. | | 206/509 |
| 6,142,330 | A * | 11/2000 | Sacks | B65D | 45/30 206/503 |
| 2001/0008251 | A1 | 7/2001 | Tsubaki et al. | | |
| 2006/0144607 | A1 | 7/2006 | Collins et al. | | |
| 2012/0304898 | A1 | 12/2012 | Schwab | | |
| 2014/0021090 | A1* | 1/2014 | Meyer-Horn | | 206/600 |

FOREIGN PATENT DOCUMENTS

| | | |
|---|---|---|
| EP | 1 886 928 | 2/2008 |
| EP | 2 484 599 A1 | 8/2012 |
| GB | 2 037 709 A | 7/1980 |
| NL | 1008541 | 9/1999 |

* cited by examiner

FIG. 5c1

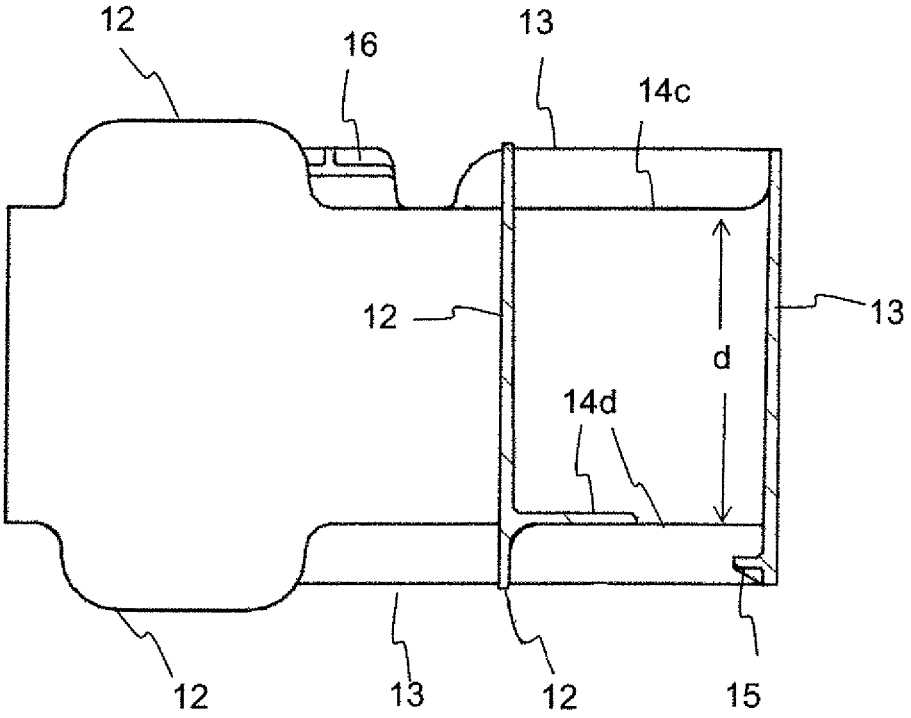
Fig. 5c2

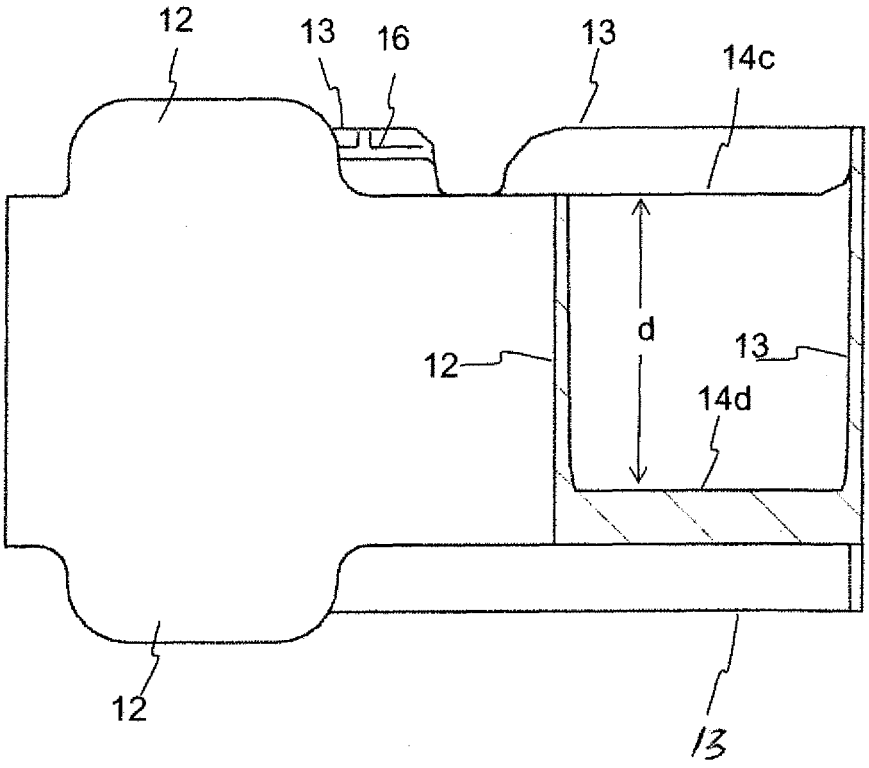
Fig. 5c3

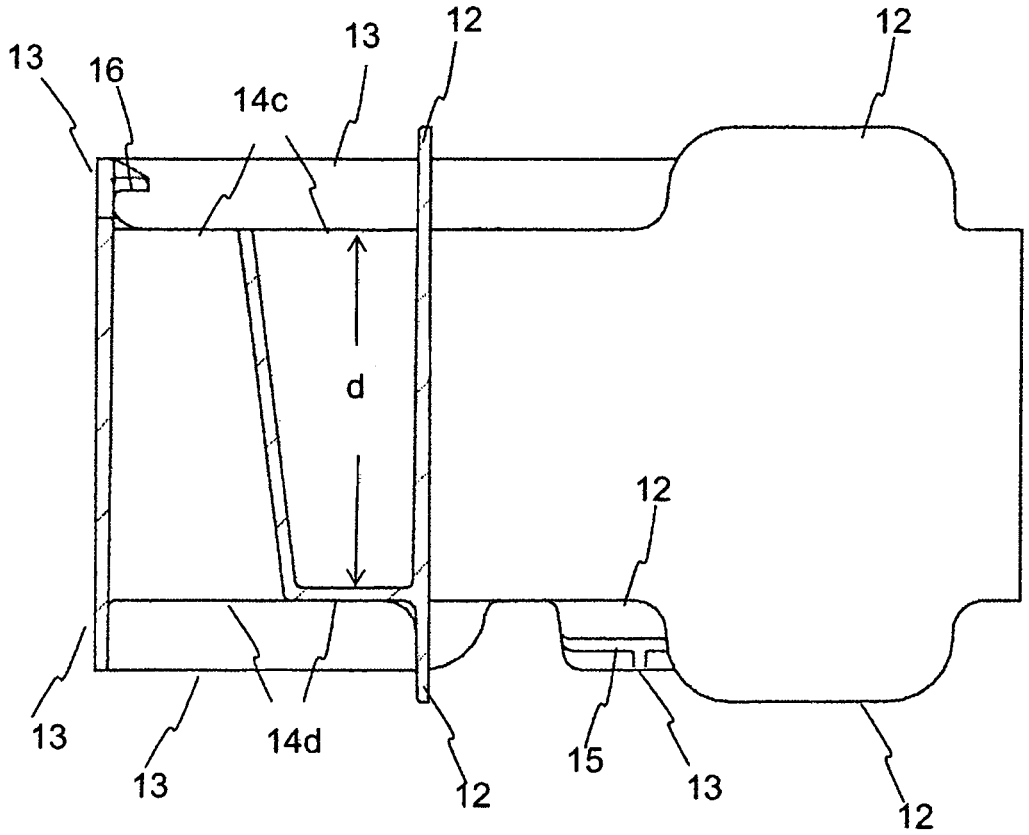
Fig. 5c4

DEVICE FOR ORIENTING A STACK OF CONTAINERS

CROSS-REFERENCES TO RELATED APPLICATIONS

This application claims the priority of Swiss Patent Application, Serial No. CH02193/12), filed Nov. 1, 2012 pursuant to 35 U.S.C. 119(a)-(d), the disclosure of which is incorporated herein by reference.

BACKGROUND OF THE INVENTION

The invention relates to a device for orienting a vertical stack of cuboid containers in particular containers with an even outer bottom surface and sidewalls that extend perpendicularly to the bottom surface. The invention also relates to a system for stacking such containers and to their space saving storage.

The following discussion of related art is provided to assist the reader in understanding the advantages of the invention, and is not to be construed as an admission that this related art is prior art to this invention.

cuboid containers made of plastic, metal, wood or cardboard for storing and transporting goods are known. In order to enable a stable vertical stacking of such containers without the containers shifting out of the vertical, containers are often provided with a typically rectangular profile on the outer surfaces of the bottoms, which can engage in the upper border of a further container. As a result, the containers are prevented from shifting sideways and the sidewalls of containers that are stacked on top of each other remain fixed in the vertical.

In cuboid containers with an even outer bottom surface without profile and with only a grid bottom on the other hand, stacking is more difficult because the containers that are stacked on top of each other can shift horizontally and are not fixed. Due to their cuboid shape and sidewalls that extend perpendicular to the bottom, the containers can also not be nested in each other as it is possible for example with containers that have sidewalls which extend slightly oblique relative to the bottom.

In EP2484599 a container with sidewalls which extend perpendicular to the bottom is disclosed at the corners of which a column-shaped element is integrated which protrudes vertically over the sidewalls. The container and the column-shaped elements form a single part. In addition the container has elongated hollow spaces at the insides of the corners in which the column-shaped elements of a second container can engage. The column-shaped elements are formed and positioned as pairs in that two diagonally opposed elements and the diagonally opposed hollow spaces have the same shape, while the two other diagonally opposed elements and hollow spaces have a slightly different shape. When the containers are stacked on top of each other, the diagonally opposed elements engage into the hollow spaces so that the containers are fixed at a distance to each other. When the containers are placed on top of each other with confronting inner spaces, the column-shaped elements engage into the hollow spaces so that a securely closed package is formed.

GB2037709 discloses a container with an even, profiled bottom and a cover, at the four corners of which a right-angled corner pillar element is put over the border of the sidewalls and is fastened by means of ribs which press into or against the sidewalls of the container. The element also has a horizontal surface in the shape of a right-angled triangle onto which a cover can be placed. Sidewalls extending perpendicularly from the horizontal surface engage through corresponding slot-shaped openings in a container stacked thereon. On the inside of the corners, the pillar-element extends up to the bottom of the container and thus acts as support of the cover and a further container stacked thereon.

It would therefore be desirable and advantageous to provide a device which enables correct stacking of cuboid containers which are open to the top and have a partially perforated, for example grid-like or ribbed, bottom with even outer surface, and to avoid a lateral displacement of the individual containers relative to each other.

SUMMARY OF THE INVENTION

According to one aspect of the present invention, a fixing element for positioning cuboid upwardly open containers in a vertical stack includes first vertical sidewalls forming a right angle with each other, wherein inner surfaces of the first vertical sidewalls form the right angle and outer surfaces of the first vertical sidewalls form an outer angle of the right angle; second vertical sidewalls; and a horizontal connecting element extending from the first sidewalls to the second sidewalls, wherein the second vertical sidewalls face at least one of the outer sides of the first sidewalls and the outer tip of the right angle formed by the first sidewalls, and wherein the connecting element extends horizontally at least in part from the outer surfaces of the first sidewalls to the second sidewalls The first and the second sidewalls of the fixing element form a right angle with the connecting element and extend from the horizontal connecting element perpendicularly upwards and perpendicularly downwards.

Fixing elements according to the invention can be form fittingly placed against the corners of a cuboid container by placing the horizontal connecting element on the upper border of the container, which is open to the top. Thereby the lower perpendicular half of the first sidewalls, which form a right angle with each other, abuts the right-angled inner walls of the container border. The lower perpendicular half of the second sidewalls abuts the outer walls of the border of the container. Due to the fact that the second sidewalls face the outer surfaces of the first sidewalls or are oriented toward the tip of the right angle formed by the sidewalls or both, the border of a container is enclosed in one of its corners by the fixing element. The upper perpendicular halves of the first and second sidewalls protrude over the border of the container. A second cuboid container, which has an even outer bottom surface and is provided with apertures at least in the region of the corners, can be placed on the first container that has the four fixing elements and can be fixed with the four fixing elements in its position relative to the first container on which it stands. The border of the container bottom form-fittingly engages between the first and second sidewalls of the fixing element in that the second sidewalls of the fixing element abut the outer sides of the border of the container on the corners of the container and the first sidewalls of the fixing element abut the inner sides of the bottom border or engage in recesses on the bottom for example along the border of a reinforcing grid structure of the bottom.

The first and second sidewalls of the fixing element have the effect that two containers that are stacked on top of each other cannot shift sideways relative to each other and in this way form a correctly vertically oriented stack. On one hand the fixing elements remain fastened due to the form fit and on the other hand they are also held in position by the own weight of the stacked container.

The fixing element enables the vertical orientation of stacks of containers with flat bottom and with perforated bottom at least in the region of the corners without integrated fixing device as disclosed in the state of the art. The fixing element can be easily removed again without tools and reused, due to the fixing by means of form fit.

The fixing element according to the invention can be applied in cuboid containers with borders of different shapes, provided that the first sidewalls form a right angle with each other and the second sidewalls face the outer sides of the first sidewalls or face the outer angle tip or both. The first sidewalls are shaped according to the inner contour of a defined border of a container and the second sidewalls are shaped according to the outer contour of the border of the same container.

In a first embodiment of the invention the first sidewalls, which form a right angle with each other, are separated from each other, wherein the tip of the angle is open and a free space is formed between the two sidewalls. This enables flexibility regarding manufacturing accuracy in the tip of the angle. In addition the fixing element can be used for different containers with different pointed or rounded inner corners of the container border.

In a further embodiment, the two first sidewalls are connected with each other in the tip of the right angle.

The second sidewalls are shaped according to the outer contour of a defined container border. The invention thus also includes different embodiments of shapes of the second sidewalls which ensure a form fitting fastening on the outer border of a container.

In an embodiment of the invention the second sidewalls of the fixing element form a curved surface, wherein the convex side faces the tip of the right angle, which is formed by the first sidewalls. This shape is suited for use in containers having a correspondingly shaped border with an indentation on the corner of the border.

In a further embodiment, the second sidewalls of the fixing element have the shape of a curved surface, wherein the concave side faces the tip of the right angle of the first sidewalls.

In a further embodiment, the second sidewalls of the fixing element, similar to the first sidewalls, are formed by one or multiple even walls. This fixing element can also be placed on corners of a container border, wherein the second sidewalls rest against the outer sides of the container.

In the mentioned embodiments, the connecting element is configured flat and with a minimal thickness corresponding to the material thickness.

The fixing element enables the fixing of the position of multiple stacked containers relative to each other so as to prevent lateral shifting and to ensure a vertical stack orientation. The fixing element allows stacking of containers in that their bottoms are always placed on an open end of a container situated there beneath. On the other hand it allows the stacking of containers in that open sides are placed on open sides and bottoms are placed on bottoms, wherein in the latter stacking, storage spaces are created that are twice the size.

In a further embodiment of the fixing element, the connecting element between the first and second sidewall is configured as spacer and for this has a predetermined thickness, wherein the first and second sidewalls protrude in each case to the same degree along their vertical extent on both sides of the horizontal surface of the connecting element and spacer. On the other hand, in the first mentioned embodiments of the fixing element the connecting element only has a thickness so as to ensure manufacturability and to provide a minimal strength for the element due to the selected material. In contrast, in this further embodiment the thickness is greater in order to achieve a predetermined distance between two containers. Such a distance enables the stacking of two containers with their open sides facing each other, wherein a space between the containers is formed which is increased by the size of the spacers. This enables the storing of a further container between the two stacked containers. As a result, the third container can be accommodated during the transport of empties in the interior space of the two such stacked containers. The empties-volume can thus be reduced by a third.

In an embodiment of the fixing element with spacer, the connecting element not only has a predetermined thickness for spacing to achieve a distance between the stacked containers but also two or more projections on the second sidewalls, wherein the projections extend in horizontal direction of the first sidewalls. The projections are each spaced apart from the surface of the connecting element, wherein the distance between connecting element and a projection corresponds to the vertical thickness of a container border.

Projections of this type enable an additional fastening of the fixing element at the border of a container in addition to the formfitting fastening in that the projections enable a snap-in fastening on the border of the container. The snap-in fastening can also easily be released again in that the projections, depending on the material thickness and the shape of the container border, are dimensioned greater or smaller.

The at least two projections are each arranged diagonally offset in that a first projection is arranged at a second sidewall above the horizontally extending surface of the connecting element and a second projection is arranged at a second sidewall on one hand underneath the horizontally extending surface of the connecting element and on the other hand offset at a sidewall which extends at a right angle to the sidewall at which the first projection is arranged.

By way of projections arranged in this manner the fixing element is fastened by at least one snap-in fastening at the border of a first container and by at least one snap-in fastening at the border of a second container, wherein the two fastenings are arranged at different sides of the containers. This enables a sufficient fixing of a stack of containers.

The invention includes the mentioned embodiments and also any desired combinations of the mentioned embodiments.

In a system for stacking cuboid containers with even outer bottom surfaces, cuboid containers are fixed in position and vertically oriented by means of fixing elements of the aforementioned type. The fixing elements enable different combinations of stacked containers. For example two respective containers can be stacked with their open ends facing each other, wherein their relative position is fixed by means of a fixing element with a connecting element as spacer. A third container can be arranged in the inner space which is formed by the two stacked containers.

Multiple such stacks of two respective containers with a respective third container in their inner space can again be stacked on top of each other in that a respective fixing element with flat connecting element of a small thickness according to the first embodiment is arranged on the four corners of the upper one of the two stacked containers. The bottom of a further stack of two containers with the third container in the inner space can be placed on these fixing elements and fixed.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 5*c*1 shows a schematic perspective view of the embodiment of FIG. 5*c*

FIG. 5*c*2 shows a cross sectional view of the embodiment of FIG. 5*c* taken along line I-I.

FIG. 5*c*3 shows a cross sectional view of the embodiment of FIG. 5*c* taken along line II-II.

FIG. 5*c*4 shows a cross sectional view of the embodiment of FIG. 5*c* taken along line III-III.

DETAILED DESCRIPTION OF PREFERRED EMBODIMENTS

Figure 1A:
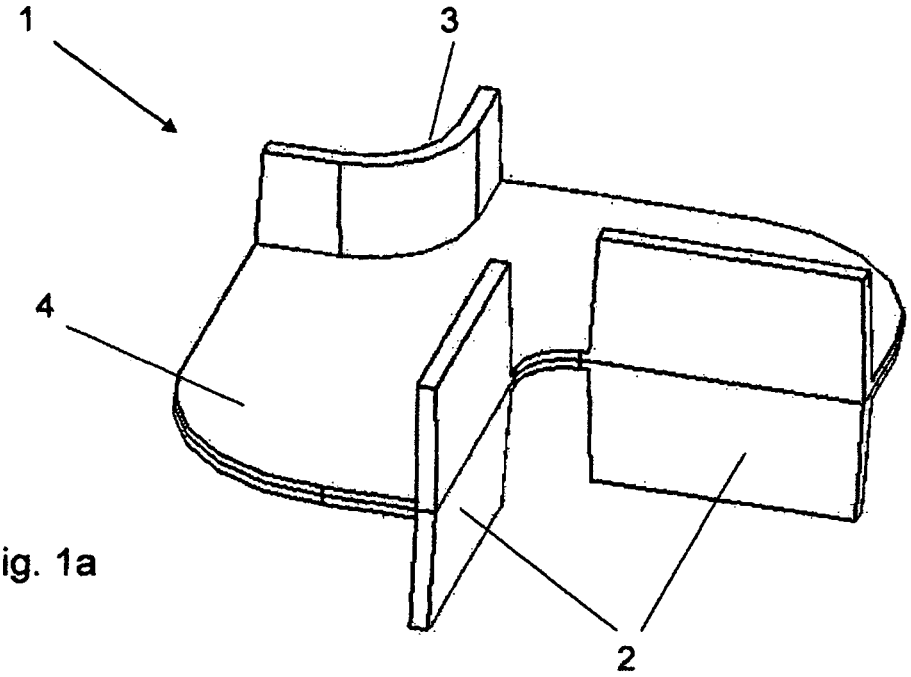
FIG. 1*a* shows a perspective view of the fixing element according to the first embodiment of the invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1B:
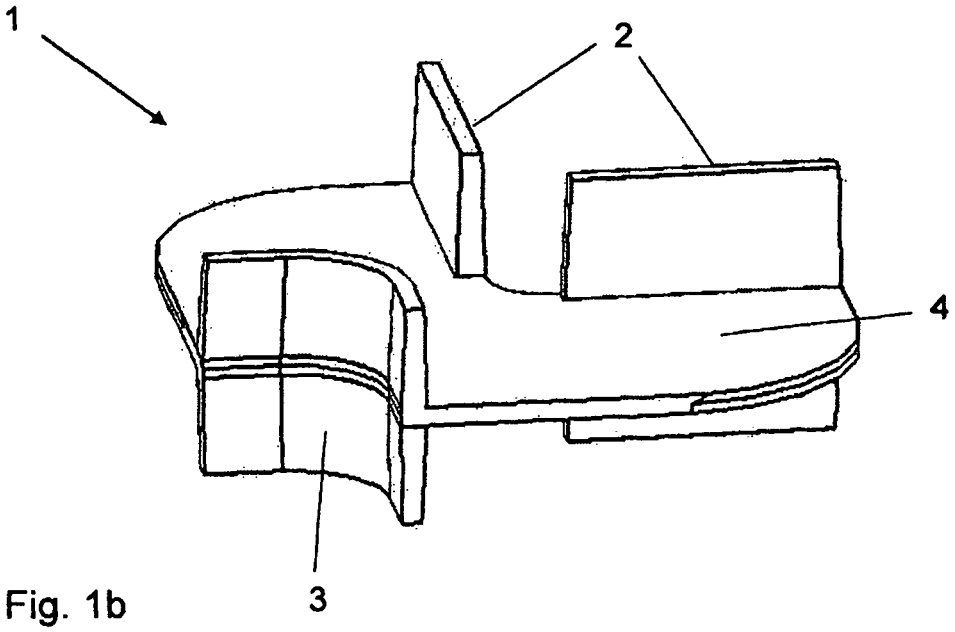
FIG. 1*b* shows another perspective view of the fixing element according to the first embodiment of the invention
Figure 2:
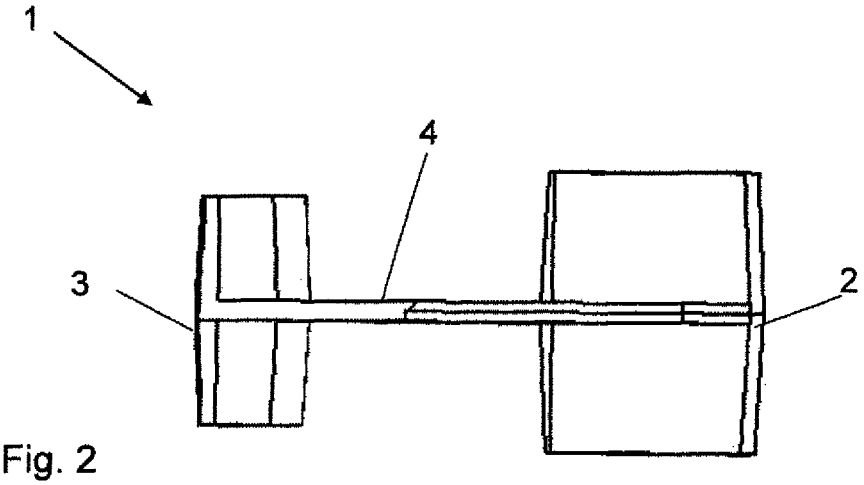
FIG. 2 shows a side view of the fixing element of FIGS. 1*a* and 1*b* taken on II in FIG. 1*b*.

Turning now to the drawing, and in particular to FIGS. 1*a* and 1*b*, there is shown an example of the fixing element 1 according to the invention of a first embodiment for vertical orientation of square shaped containers. The first sidewalls 2 and the second sidewalls 3 are shown which are all vertically oriented and interconnected by a flat connecting element 4. The connecting element extends in each case horizontally from the center of the vertically extending sidewalls 2 to the vertical center of the second sidewalls 3 as also shown in the side a view in FIG. 2.

Figure 3:
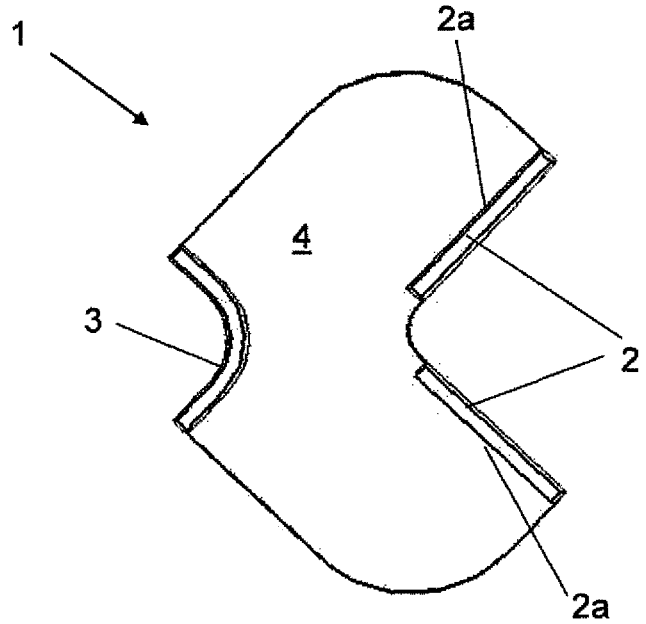
FIG. 3 shows the fixing element of FIG. 1 in a side view from the top.

In the shown example of the fixing element, as can be in particular seen in the top view in FIG. 3, the first sidewalls 2 are configured even and so as to form a right angle with each other corresponding to the shape of the inside of a container border. The connecting element 4 extends over the outer angle of 270° of the right angle formed by the first sidewalls 2. The first sidewalls are arranged separate from each other so that a free space exists at the tip of the right angle formed by the first sidewalls. The second sidewalls 3 face the tip of the right angle of the first sidewalls and also face the outer sides 2*a* of the first sidewalls 2, which means they face the outer sides of the walls 2, which form the outer angle. In the shown example they are configured rounded and are shaped corresponding to an indentation at the outside of the border of a container. The second sidewalls 3 can also be curved outwardly corresponding to an outwardly curved border. In addition, similar to the first sidewalls, the second sidewalls 3 can be configured as two even walls that form a right angle with each other and face the outer sides of the first sidewalls. As an alternative they can also form a single even surface which faces the outer tip of the right angle of the first sidewalls in case a container has a border with a corner portion which extends obliquely to the sidewalls. In each case the one or multiple second side sidewalls face the outer sides 2*a* of the first sidewalls 2 or the tip of the right angle.

When the connecting element 4 is used as fixing element in cuboid containers i.e., containers with sidewalls that extend perpendicular to the bottom, the connecting element 4 can be joined to a corner part of the border 5*a* of a container 5 as is shown in FIGS. 4*a-d*, wherein the first sidewalls 2 of the fixing element 1 rest against the inner side of the border 5*a* and the second sidewalls 3 of the fixing element 1 rest against the outer side of the border 5*a*. For this the first and second sidewalls 2 and 3 are shaped according to the shape of the border 5*a* of the container 5.

Figure 4A:
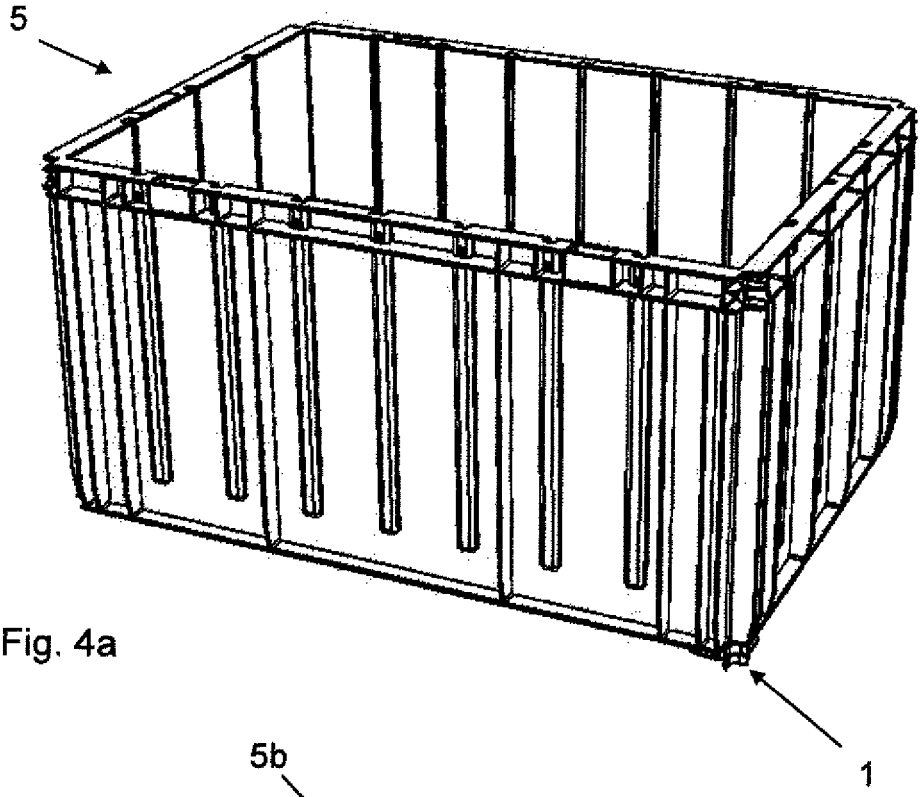
FIG. 4*a* shows a perspective view of a fixing element according to the invention used at the corner on the grid-shaped bottom of a cuboid container with a border having an inwardly oriented indentation.
Figure 4B:
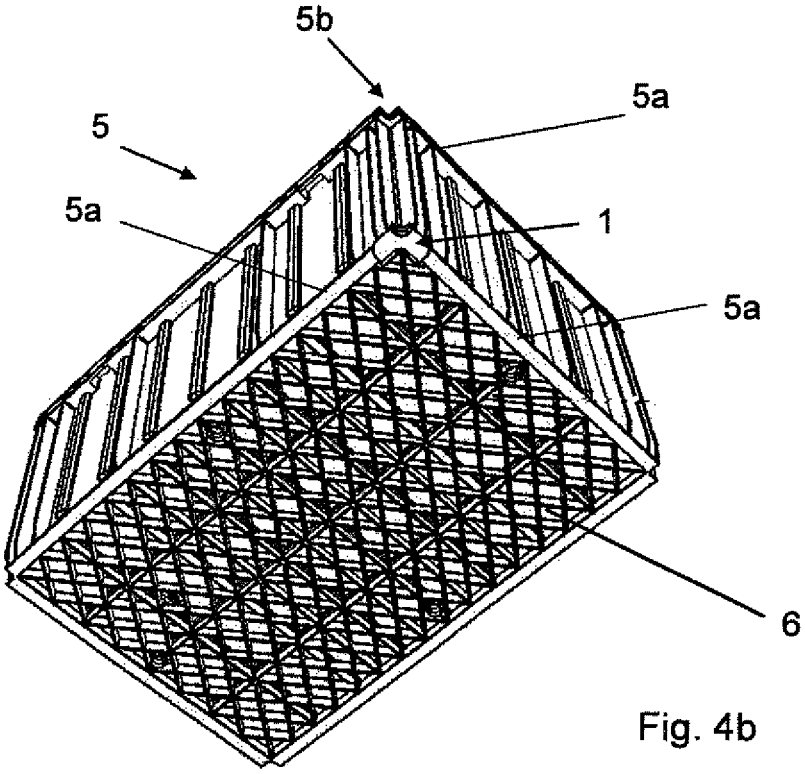
FIG. 4*b* shows a bottom perspective view of the embodiment of FIG. 4*a* and in particular the engagement of the sidewalls with the border on the grid-shaped bottom of the container.
Figure 4C:
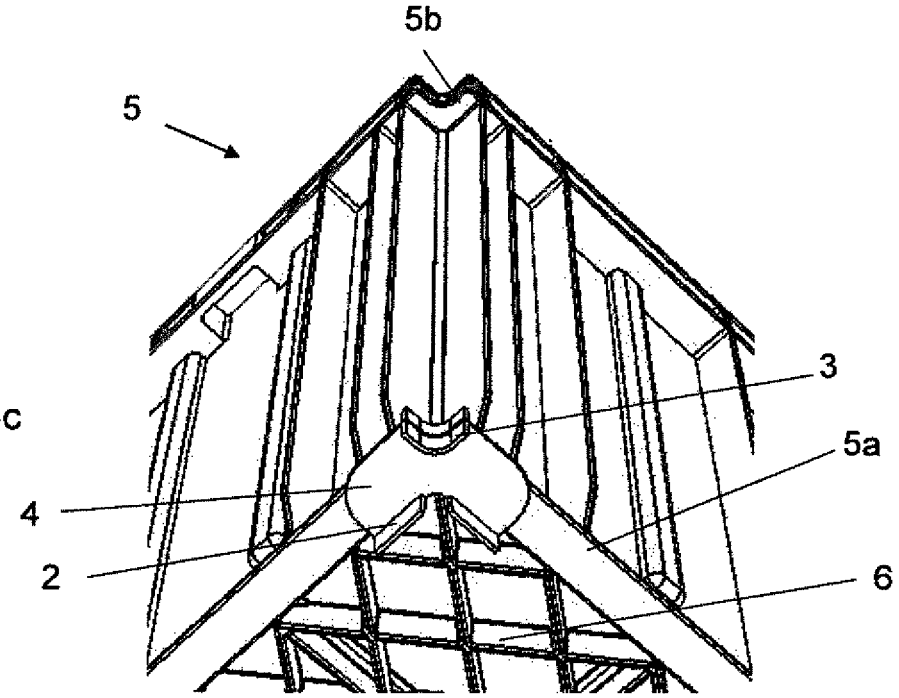
FIG. 4*c* shows an enlarged view of the fixing element of FIG. 4*b*.
Figure 4D:
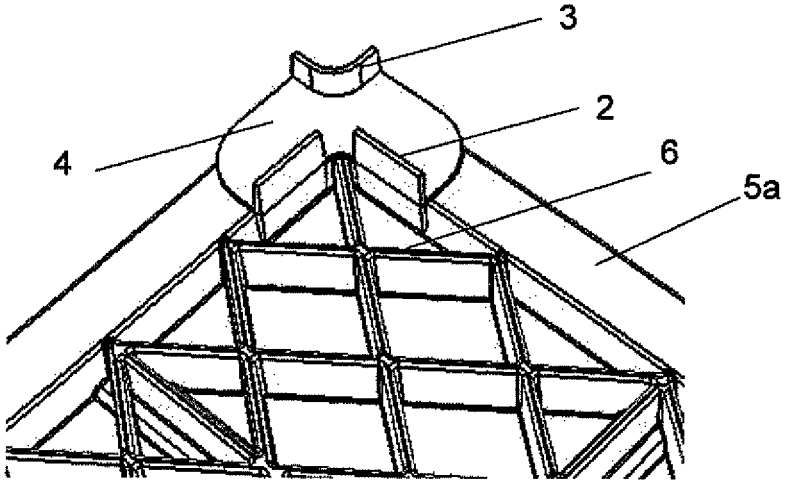
FIG. 4*d* shows another enlarged view of the fixing element of FIG. 4*b*.

FIGS. 4*a-d* show a fixing element 1 according to the invention arranged on one of the corners at the lower border 5*a* with the flat connecting element 4 resting on the border 5*a* and the first sidewalls 3 and the second sidewalls 3 form fittingly resting against the outer or inner side of the border 5*a*. The border at the upper and open end and the lower border along the bottom 6 of the container 5 have an indentation 5*b* at their outer sides. The curved sidewall 3 of the fixing element 1 rests against this indentation 5*b*. The first straight and right-angled sidewalls 2 rest against the inner side of the border 5*a* and engage form-fittingly in the border of the grid-shaped or ribbed bottom 6 as shown in FIG. 4*c*. The rounded surfaces of the second sidewalls 3 form-fittingly rest against an indentation at the lower border along the bottom 6, wherein the indentation is configured in the same way as the indentation 5*b* at the upper border on the open end of the container. A fixing element 1 can be fastened on the corners on the lower border as well as on the corners on the upper border. FIG. 4*d* shows an enlargement of the formfitting arrangement of the first sidewalls 2 on the inner walls of the container border 5*a* of the container bottom 6.

In order to fix multiple of the containers 5 in their relative horizontal position and to vertically orient these containers, fixing elements 1 are fastened at all four corners of the upper border of each container. The corners at the lower border of each container are placed on the fixing elements 1 of a container that is situated underneath and with this fixed in their position. This allows stacking any number of containers 5 vertically on top of each other.

Figure 5A:
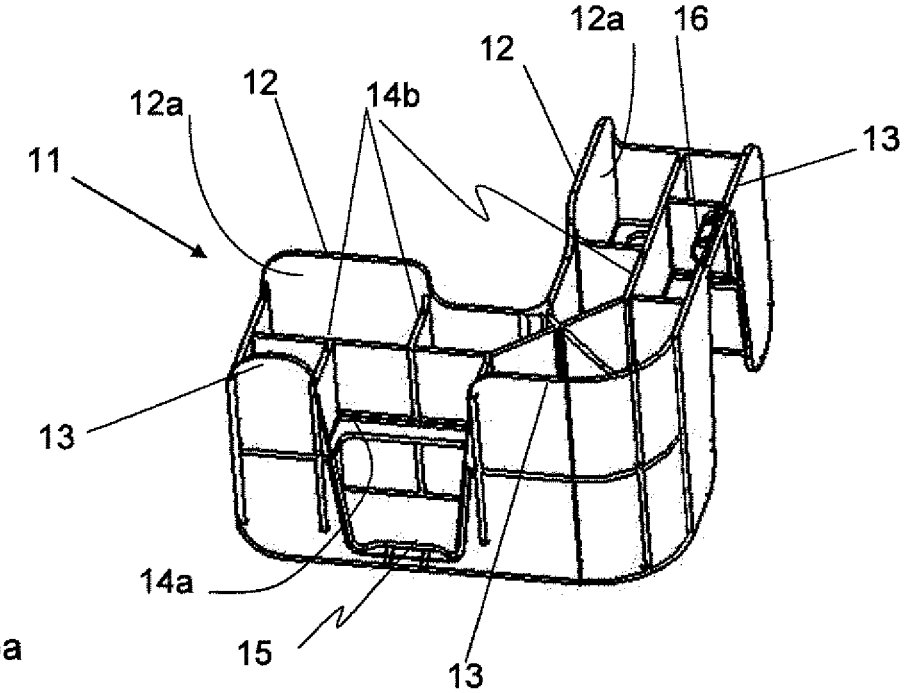
FIG. 5*a* shows a perspective view of the fixing element according to the invention according to the second embodiment of the invention with a connecting element as spacer.
Figure 5B:
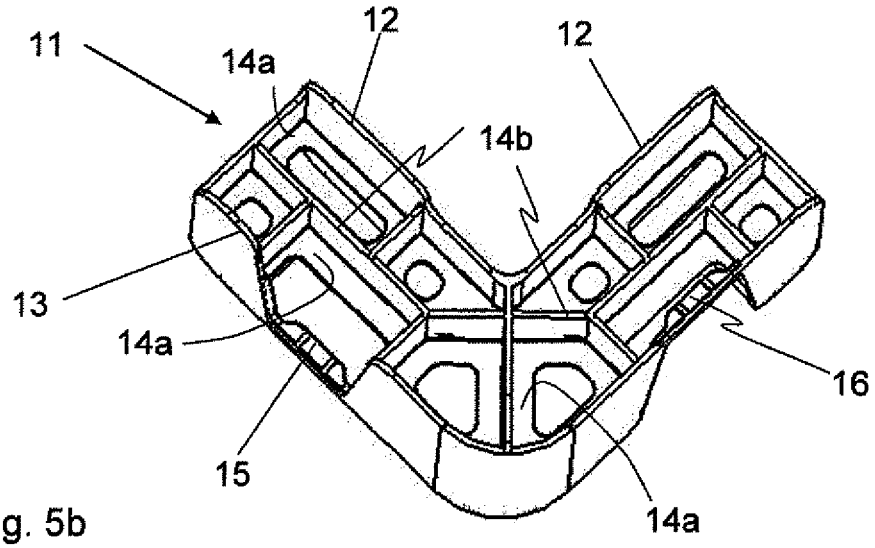
FIG. 5*b* shows another perspective view of the fixing element according to the invention according to the second embodiment of the invention with a connecting element as spacer

An embodiment of the fixing element 11 according to the invention according to FIG. 5*a* again has first inner sidewalls 12, which form a right angle with each other, and second outer second sidewalls 13, wherein the second sidewalls 13 face the outer sides 12*a* of the first sidewalls 12. The first and second sidewalls 12 and 13 are interconnected by a connecting element 14*a, b* wherein the connecting element 14*a, b* is configured as spacer. As such the connecting element 14*a, b* in this configuration has on one hand a horizontal flat part 14*a*, which extends from the center of the vertical extent of the first sidewalls 12 to the center of the vertical extent of the second sidewalls 13. In addition the connecting element has ribs 14*b* for reinforcing the fixing element 11 and for forming the spacer, with the ribs having a height corresponding to a desired spacing. As a result, the connecting element has a vertical thickness, which is equal to the height of the ribs 14*b*. A horizontal projection 16 extends from the second sidewall 13 over the vertical extent of the ribs 14*b* of the connecting element and towards the first sidewall 12. A distance is formed between the projection 16 and the ribs 14*b* of the connecting element, which corresponds to the thickness of the border of the container to which the fixing element may be applied.

A second projection 15 extends from a further part of the second sidewall 13 toward the first sidewalls 12, wherein again a distance exists between the projection 16 and the vertical extent of the ribs 14*b* of the connecting element which distance corresponds to the thickness of the border of a container. The two projections 15 and 16 are diagonally offset relative to each other in that on one hand they are arranged at sidewalls that form a right angle with each other and on the other hand at different sides which means at the upper and lower side of the ribs of the connecting element.

Figure 5C:
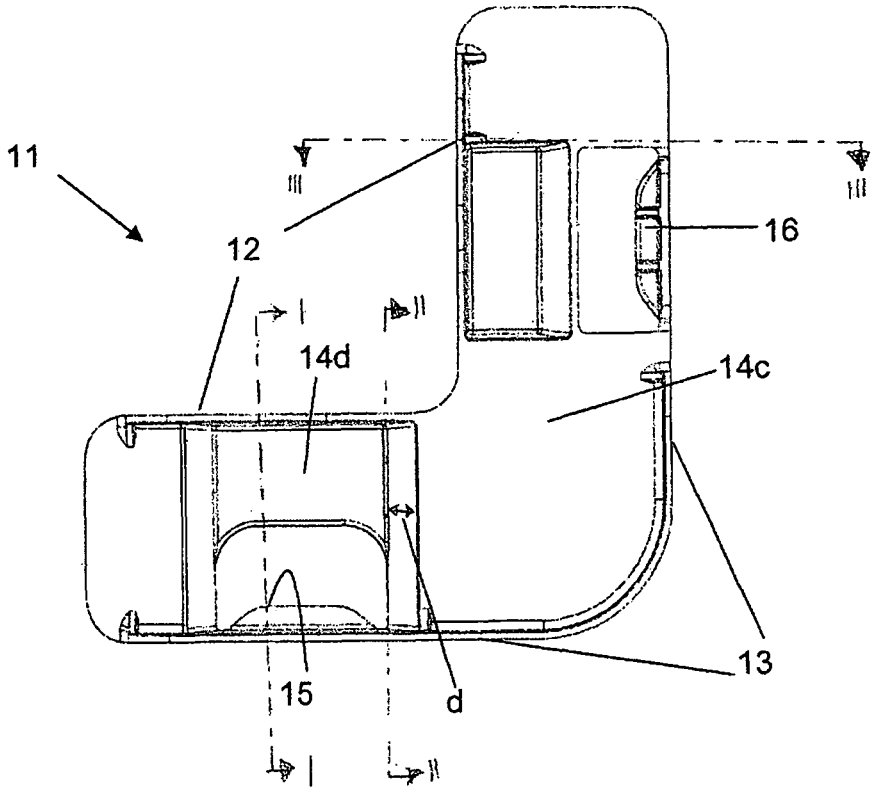
FIG. 5*c* shows a top perspective view of a further embodiment of the fixing element according to the invention with a connecting element as spacer.
Figure 5C:
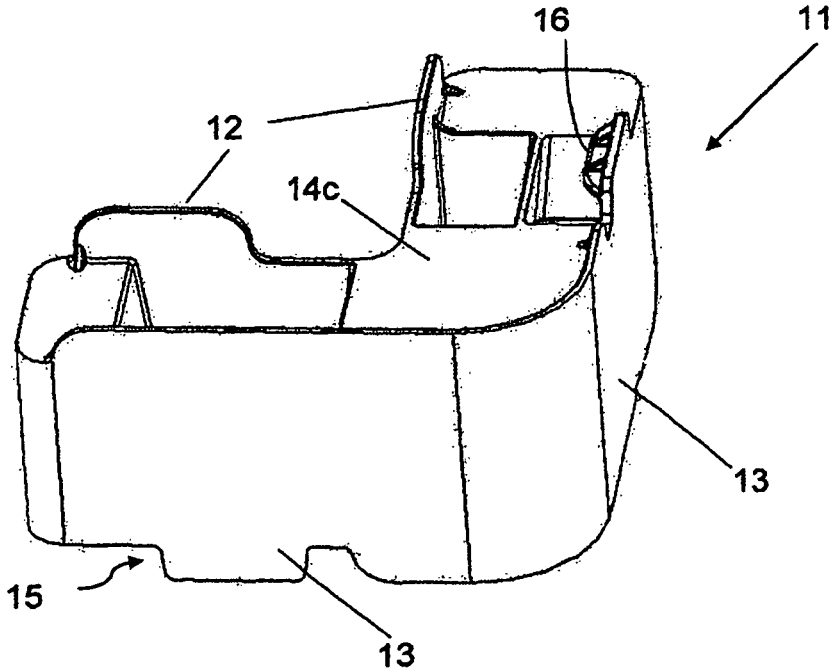

In a further embodiment of the fixing element 11 according to two views in FIG. 5*c*, the connecting element has no ribs. Instead, horizontal surfaces 14*c* and 14*d* extend at least partially from the second sidewalls 13 towards the first sidewalls 12, in each case at a height which is spaced apart by a predetermined distance from the upper and lower border of the vertical sidewalls 12, 13. The surface 14*c* extends at a distance below the upper border of the sidewalls 12 and 13 and the surface 14*d* extends at a distance above the lower border of the sidewalls 12 and 13. FIG. 5*c* shows that surfaces 14*c* and 14*d* are spaced apart in vertical direction by a distance d (see also cross sectional views of FIGS. 5*c*2, 5*c*3 and 5*c*4). Similar to in the embodiment from FIGS. 5*a* and *b*, the projections 15 and 16 are again arranged at the borders of the second sidewall 13, wherein the projection 16 is arranged above the surface 14*c* or below the horizontal surface 14*d* and extends towards the first sidewalls. The distance between the horizontal surface 14*c* and the projection 16 and the distance between the horizontal surface 14*d* and the projection 15 corresponds in each case to the thickness of a container border on which the fixing element can be applied.

For use on a cuboid container 5 as shown in FIGS. 5*d-g*, a fixing element 11 is placed on each corner of a container border 5*a*, wherein the ribs 14*b* of the connecting element come to rest on the border 5*a*, the first sidewalls 12 on the inside of the border, and the second sidewalls 13 on the outer sides of the border 12. The projections 15 and 16 serve for snap-in fastening at the border 5*a* in that the border 5*a* is clamped between connecting element 14*a, b* and the projection 15. When a second container 7 is placed on the container 5 the second container is fixed by clamping its border 7*a* between the projection 16 and the connecting element 14*a, b*. The clamping effect is sufficient so that a fixing of the containers 5 and 7 relative to each other is achieved. Depending on the strength of the material of the fixing element and the container border, the projection can be configured greater or smaller so as to achieve on one hand a sufficient clamping effect and on the other hand the fixing element 11 can be manually released again from the border without requiring tools.

Figure 5D:
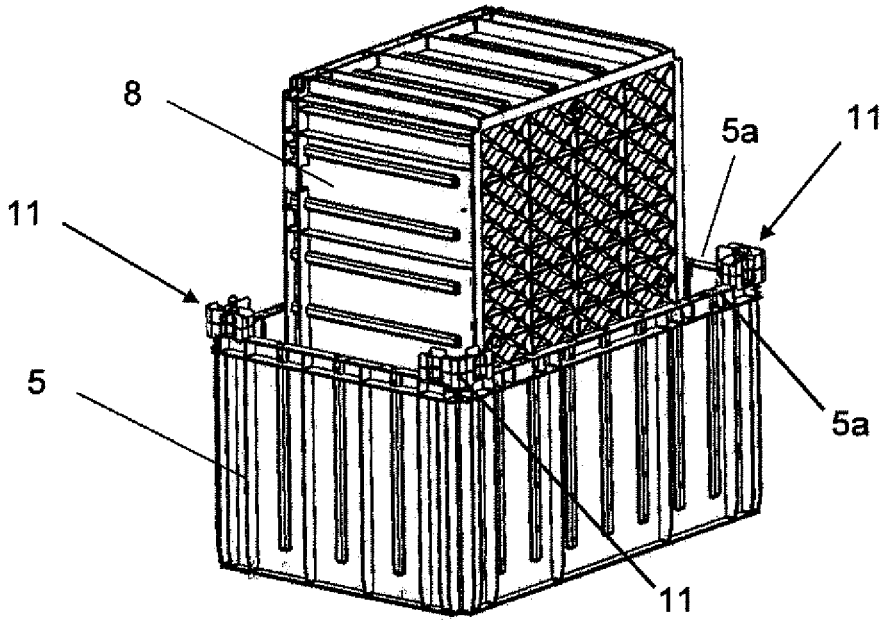
FIGS. 5*d-g* show the use of the fixing element of FIGS. 5*a* and *b* on a cuboid container for fixing its position relative to the container and form spacing apart have two containers that lie on top of each other for the purpose of accommodating a third container.
Figure 5E:
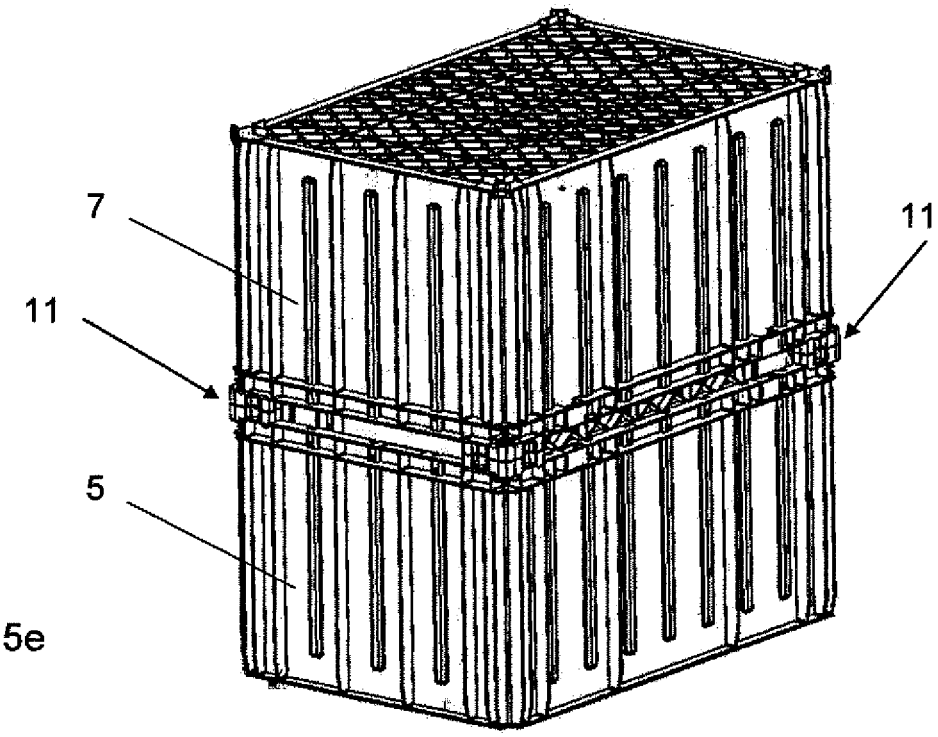
Figure 5F:
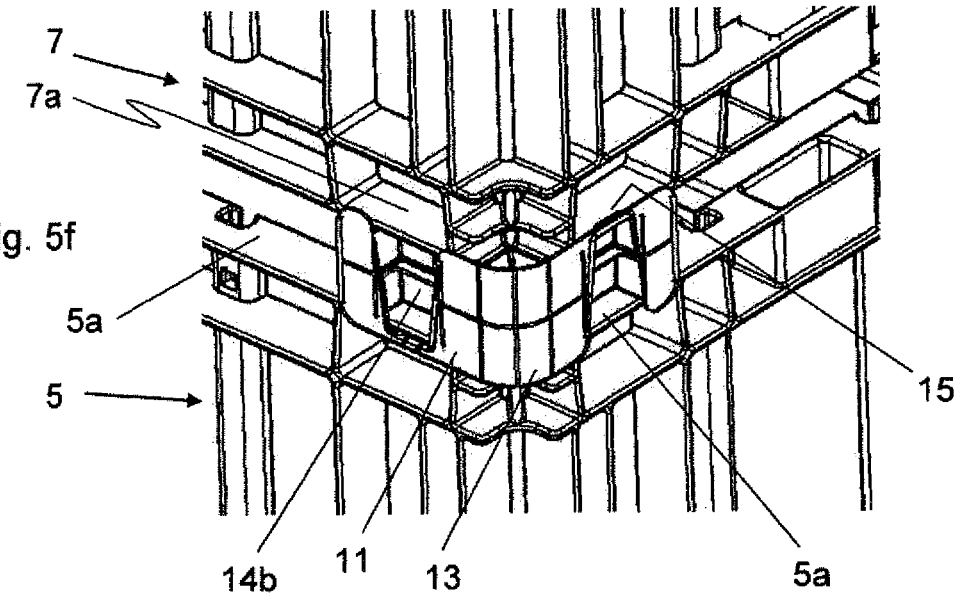
Figure 5G:
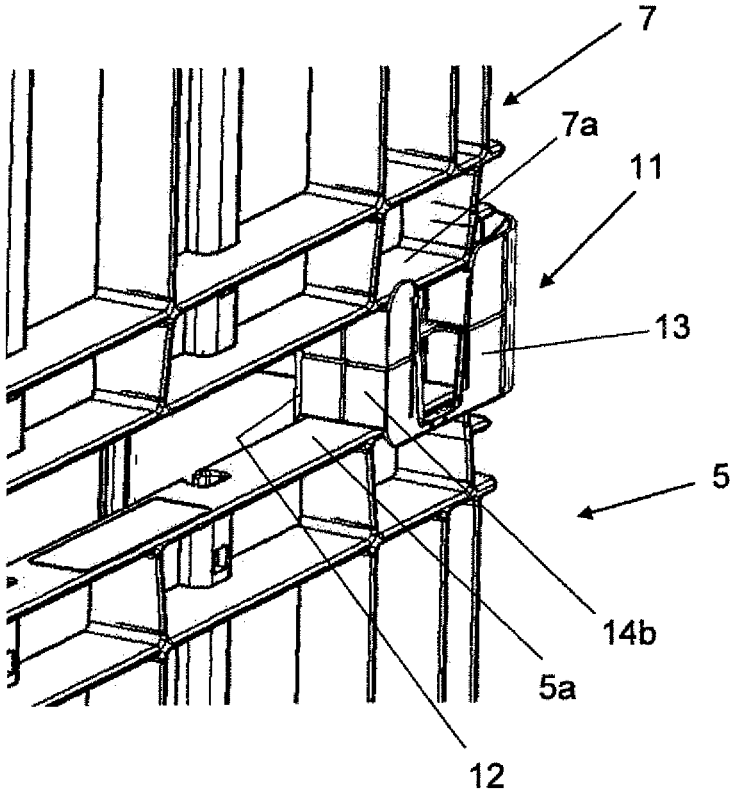

The fixing element 11 allows stacking of two containers 5 and 7 as shown in FIG. 5*e* in that the two containers are stacked with the respective open sides facing each other. As a result of the vertical height of the connecting element 11, a spacing of the two containers 5 and 7 is achieved so that a further third container 8 can be accommodated in the space that is formed by the two containers 5 and 7 as shown in FIG. 5*d*. This allows transporting empty containers when transporting of empties in a reduced volume. A further container 9 can be placed on the container 7 which is positioned inverted with the open side facing downward, wherein this further container can be fixed relative to the container 7 by means of a fixing element 1 of the first embodiment of the invention.

Figure 6:
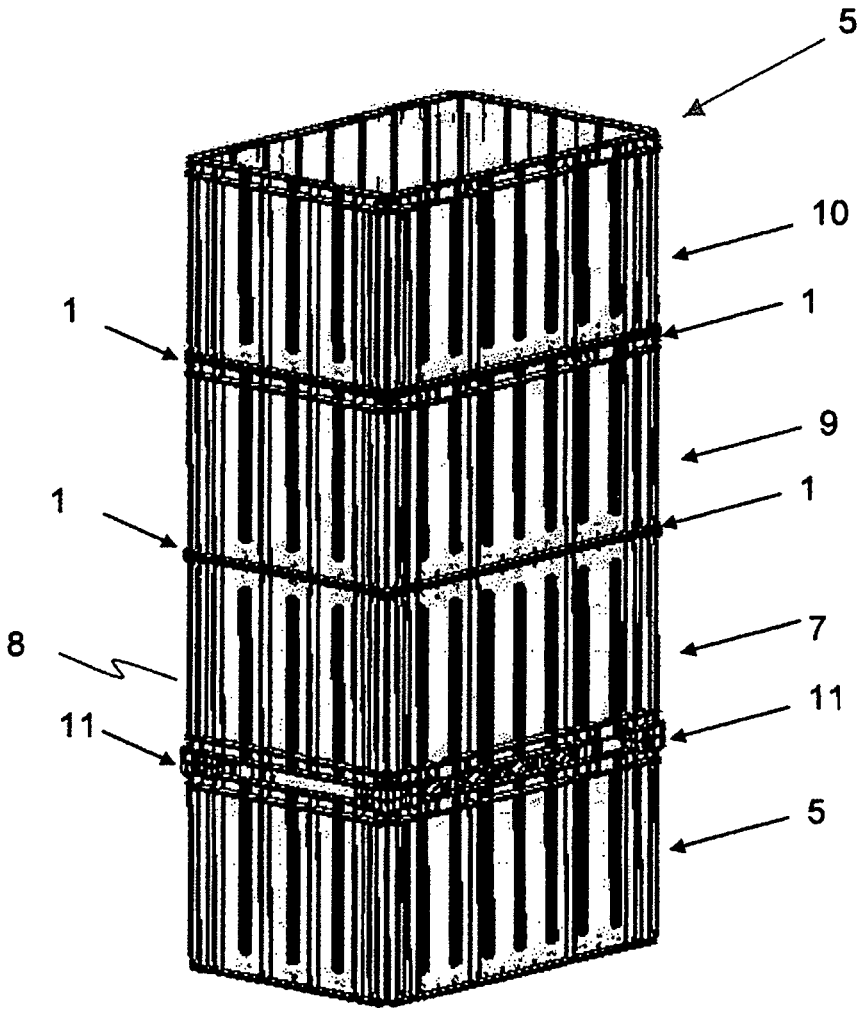
FIG. 6 shows a system of stacked cuboid containers, which are oriented by means of the fixing elements according to the invention.

Thus, any number of cuboid containers with flat bottoms can be stacked by means of fixing elements 1 without spacing and/or by means of fixing elements 11 with spacing and with or without accommodated container 8. FIG. 6 shows an example of such a combined system according to the invention. Here, two containers 5 and 7 are fixed at the "bottom" relative to each other with fixing elements 11 according to FIGS. 5*a-g*, wherein owing to the spacing between the borders of the two containers 5 and 7 a further container 8 can be accommodated between the two. On the upwards oriented bottom of the container 7, a container 9 is stacked by means of fixing elements 1 according to FIGS. 1-4. Onto this upwardly open container 9 a further container 10 is then positioned by means of the fixing element 1 according to FIGS. 1-4.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A fixing element for positioning cuboid, upwardly open containers having container borders in a vertical stack, comprising:

an L-shaped element having first and second legs forming a right angle with each other, each said first and second legs having parallel extending inner and outer vertical sidewalls, wherein the inner and outer vertical sidewalls have a substantially equal vertical extent;

first and second horizontal connecting elements extending from the inner vertical sidewalls to the outer vertical sidewalls, said first and second horizontal connecting elements being separated in vertical direction by a predetermined distance and each horizontal connecting element extending from the inner to the outer vertical sidewalls at a level close to but spaced apart from an uppermost and lowermost vertical end of the inner and outer vertical sidewalk respectively;

a first, single horizontally protruding element arranged on the outer vertical sidewall of the first leg between an upper one of the horizontal connecting elements and the uppermost end of the outer vertical sidewall, said first horizontally protruding element protruding horizontally from the outer vertical sidewall of the first leg toward the inner vertical sidewall of the first leg; and a second, single horizontally protruding element arranged on the outer vertical sidewall of a second leg between a lower one of the horizontal connecting elements and the bottommost end of the outer vertical sidewall, said second horizontally protruding element protruding from the outer vertical sidewall of the second leg toward the inner vertical sidewall of the second leg, wherein a first distance between the first, single horizontally protruding element and the first horizontal connecting element and a second distance between the second, single horizontally protruding element and the second horizontal connecting element each correspond to a thickness of said container border on which said fixing element is applied.

* * * * *